United States Patent [19]

Heidelberger et al.

[11] Patent Number: 4,492,128

[45] Date of Patent: Jan. 8, 1985

[54] CONTROL MECHANISM

[75] Inventors: Walter Heidelberger, Klarenthal; Joachim Morsch, St. Wendel, both of Fed. Rep. of Germany

[73] Assignee: bso Steuerungstechnik GmbH, Sulzbach, Fed. Rep. of Germany

[21] Appl. No.: 370,203

[22] Filed: Apr. 21, 1982

[30] Foreign Application Priority Data

May 2, 1981 [DE] Fed. Rep. of Germany ..... 3117414

[51] Int. Cl.[3] ..... G05G 9/04; H01C 10/16; H01H 25/04

[52] U.S. Cl. ..... 74/471 XY; 200/6 A; 338/128

[58] Field of Search ..... 137/636.2; 74/471 XY; 200/6 A; 338/128

[56] References Cited

U.S. PATENT DOCUMENTS

| | | | |
|---|---|---|---|
| 2,958,233 | 11/1960 | Johnson | 137/636.2 X |
| 3,350,956 | 11/1967 | Monge | 74/471 XY |
| 3,731,013 | 5/1973 | Nightengale | 200/6 A X |
| 3,870,161 | 3/1975 | Cording | 74/471 XY X |
| 4,421,135 | 12/1983 | Harshman et al. | 137/636.2 X |

FOREIGN PATENT DOCUMENTS

| | | | |
|---|---|---|---|
| 1853867 | 3/1962 | Fed. Rep. of Germany | |
| 1268251 | 5/1968 | Fed. Rep. of Germany | 200/6 A |

*Primary Examiner*—Allan D. Herrmann
*Attorney, Agent, or Firm*—Walter C. Farley

[57] ABSTRACT

A control mechanism includes a control lever extending through an opening in a guide plate into a housing where it is pivotally attached. A frustoconical member is slidably mounted on the lever and spring-urged against the opening, tending to return the lever to a control position. A control plate is attached to the frustoconical member and can operate switch actuators.

5 Claims, 3 Drawing Figures

CONTROL MECHANISM

This invention relates to an apparatus of the type in which a control lever, or so-called "joy Stick", is moved in various directions to control the operation of, for example, electromagnetically operated valves in a hydraulic system.

BACKGROUND OF THE INVENTION

In a prior art control device, shown in German No. GM 1,853,867, the structural elements include a plate which is rounded off on its edge and a template or pattern member in the shape of a hollow cone, the peak of which is the swivel point of the control lever. The template has two grooves opposite each other in which each limitative wall is in the shape of a circular arc in transverse cross section. Two potentiometers are mounted in two perpendicular guide planes and can be adjusted with this known control mechanism.

BRIEF DESCRIPTION OF THE INVENTION

An object of the present invention is to provide an apparatus in which the control functions are expanded.

A further object is to provide a simple and reliable mechanism in which a movable lever operates enabling switches as well as signal level adjusting devices.

Briefly described, the invention includes a control mechanism particularly useful in controlling electrical energy fed to electromagnets for actuating valves in a hydraulic system comprising a housing; a guide plate mounted on said housing, said plate having an opening therein; at least one electrical component having an operator element extending through said guide plate adjacent said opening; a control level extending through said opening, said control lever having a handle outside of said housing and a coupling and mounted within said housing to permit movement of said lever in various directions from a control, rest position; a frustoconical pivot member slidably mounted coaxially on said control lever with the smaller end thereof extending into said housing through said opening, the larger end thereof being dimensioned to engage said opening; a restoring spring urging said pivot member toward said coupling end of said lever; a control plate attached to the larger end of said pivot member for tilting movement with said pivot member and said lever between a rest position with the rest position of said lever in which said control plate engages said operator element and tilting positions in which said element is not engaged.

As indicated, at least one operator element of an electrical component can be actuated by the control plate when the lever is in its rest position. The element can be the pin or button of a microswitch or the like so that, when the control lever is in its rest position, the control system can be disconnected. This considerably increases the security of the control mechanism.

Additional features of the invention are particularly advantageous if the elements to be adjusted include the operating shaft of a potentiometer which is to be operable only after the control lever has been moved through a certain distance. It is thus possible to contain at least one microswitch within the housing of the control mechanism without an additional part. In addition, a detent arrangement is provided which permits the operator to sense certain control positions of the control lever without being able to visually observe the lever.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
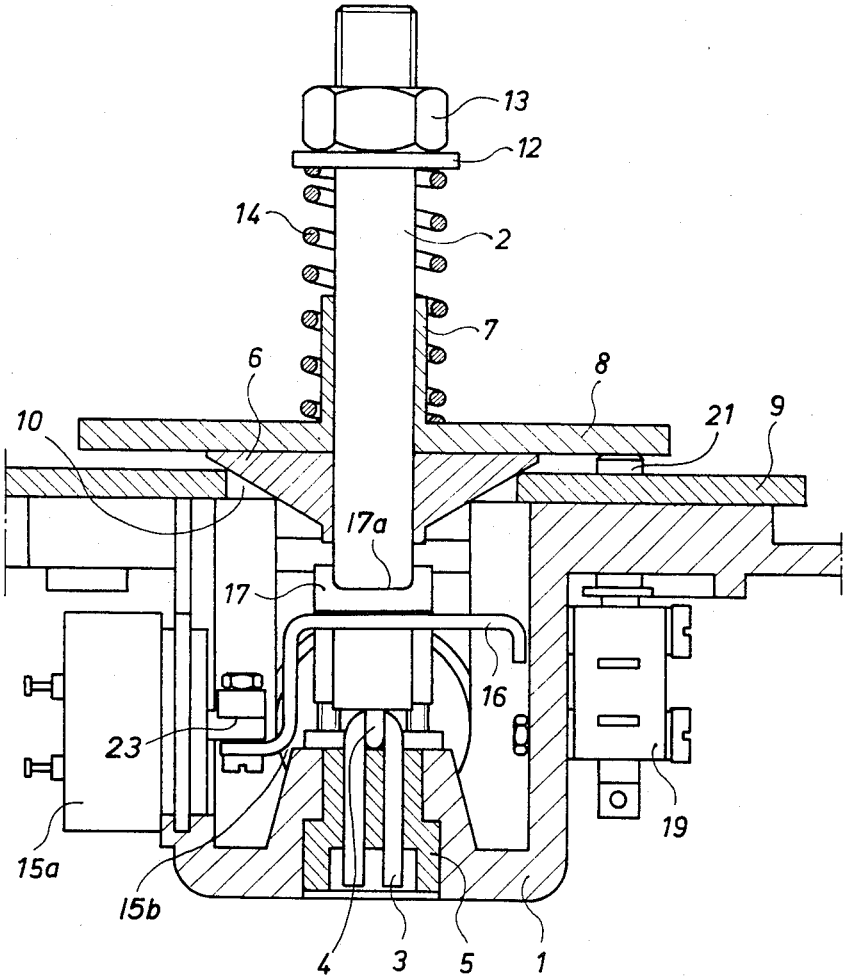
FIG. 1 is a side elevation, in section, of a control mechanism in accordance with the present invention.
Figure 2:
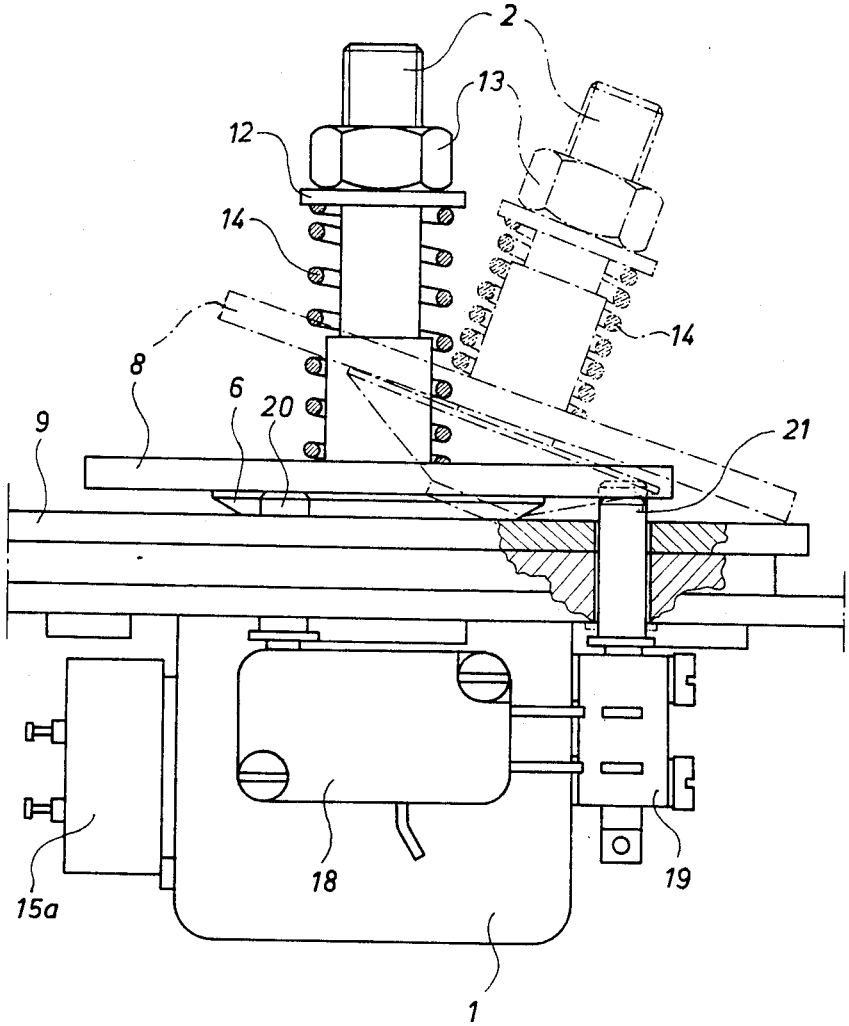
FIG. 2 is a side elevation, in partial section, of the apparatus of FIG. 1 showing the control lever thereof in alternative positions.
Figure 3:
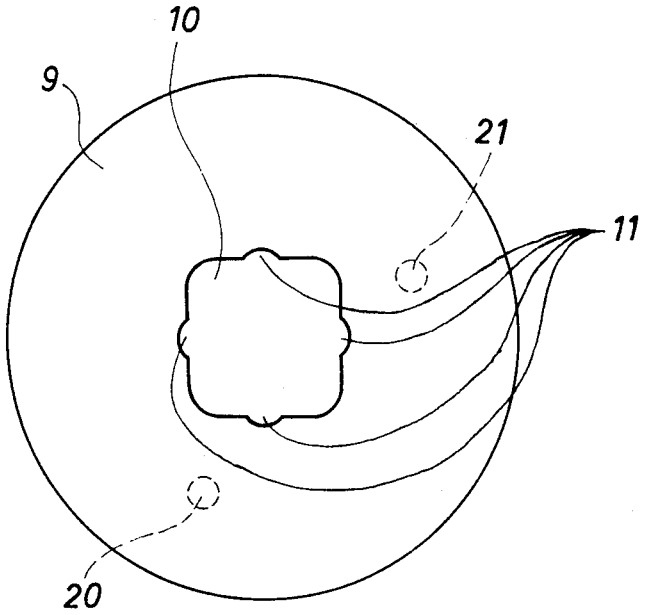
FIG.3 is a plan view of a guide plate, by itself, usable in the apparatus of FIGS. 1 and 2.
Figure 4:
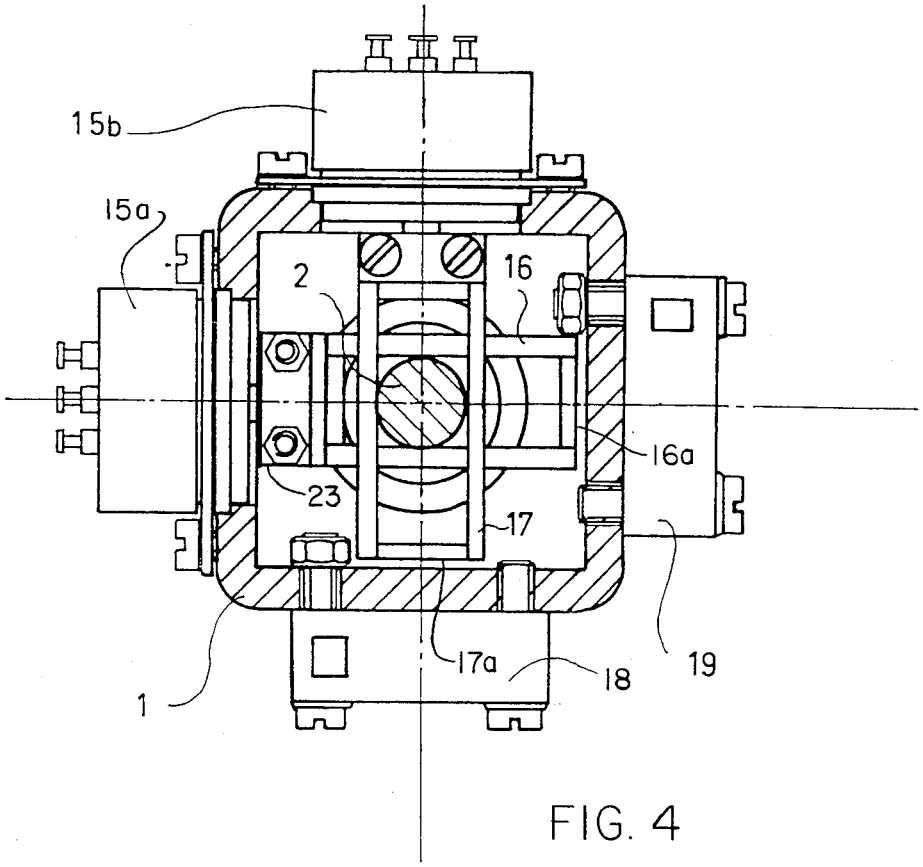

As seen in FIGS. 1 and 2, the control mechanism includes a control lever 2, the upper end of which is designated to receive a handle, not shown, and the lower end of which is provided with a swivel coupling within a generally quadrilateral housing 1. The swivel connection includes two rods 3 and 4 which are bent into U shapes and inter-engage each other, the rods lying in perpendicular planes. Rod 3 is connected to a holding element 5 which has a support shoulder engaging a suitable recess in housing 1; and rod 4 is connected in the lower end of lever 2, preferably by soldering. The U-shaped rods 3, 4 form an articulation which is substantially free of play and which permits lever 2 to be pivoted in all directions. A frustoconical element 6, the conical surface of which faces downwardly, surrounds lever 2 and is axially slidable along the lever. A control plate 8 lies adjacent the large end of cone 6 and has an upwardly extending sleeve 7 which surrounds lever 2, plate 8 also being axially movable on the lever. Conical element 6 is dimensioned so that the downwardly pointing smaller end thereof extends through the opening 10 in a guideplate 9 which lies across the upper end of housing 1, a suitable guideplate being illustrated alone in FIG. 3. Plate 9 has an essentially rectangular opening 10 through which portions of lever 2 and cone 6 extend, all corners of the opening being rounded. In the middle of each of the sides of opening 10 is provided a notch 11 which forms a detent for the engagement of the control stick. With this, certain positions of the control stick can be felt by the operator even when the stick is not being visually observed. The diagonal dimension of opening 10 is the same as the greatest distance between the walls of two opposite detent notches 11.

A compression coil restoring spring 14 is provided around the upper portion of lever 2 between the upper surface of control plate 8 and the lower surface of a washer 12, the washer being retained in position near the end of the lever by a nut 13 threadedly engaging the end of the lever. With the spring compressed between plate 8 and washer 12, the action of the spring urges plate 8 downwardly toward the articulated joint.

Two potentiometers 15*a*, 15*b* are attached to adjacent sides of housing 1 so that the operating shafts of the potentiometers extend perpendicular to each other. Each of the potentiometers 15*a*, 15*b* has an operating member 16 or 17 attached to its shaft by a clamp 23 within the housing and coupled to lever 2 each operating member having a transverse end portion 16*a*, 17*a*. The pivot axes of members 16, 17 extend perpendicular to the axis of control stick 2 when it is in its rest position as shown in FIG. 1 and in solid lines in FIG. 2. Both operating members 16, 17 are of the same configuration and are so arranged that portions lie both over the potentiometer axis and beneath the potentiometer axis. The entire arrangement is such that when control lever is in its rest position, the operating members 16, 17 also are in their rest positions. If lever 2 is swiveled in the direction of operating member 16, then the potentiometer 15*a* attached to member 16 works on its plus side and with the swiveling of the lever 2 in the opposite direction it works on its minus side. The positive and negative values are proportionally greater the further the lever is swiveled.

As many as eight electromagnetic operators, particularly four electromagnets, and especially proportional electromagnets can be controlled with the aid of the two potentiometers 15*a*, 15*b* using an electronic control circuit, not shown, which can also be located in housing 1. The configuration is such that lever 2 must be swiveled through a certain angle before the relevant potentiometer can be operated to produce either a positive or negative signal. Both potentiometers can also be operated simultaneously, or optionally in different ways.

Microswitches 18 and 19 are attached to two adjacent outside surfaces of the housing which are at a right angle to each other, and the microswitches are provided with operating pins 20 and 21 which extend upwardly through the mounting flange of housing 1 and guide-plate 9 and cooperate with the lower surface of control plate 8. The locations of operating elements 20 and 21 are shown in dashed lines in the plan view of FIG. 3. The operator elements 20 and 21 are preferably arranged along a diagonal line relative to rectangular opening 10. The positioning can, however, deviate from that diagonal because the potentiometer or potentiometers 15 do not come into play until after the control lever has been pivoted through a certain distance. It is possible to place microswitches 18, 19 directly on housing 1 without additional parts by positioning operating pins 20, 21 outside the diagonal.

In the position of control plate 8 shown in FIG. 1, operators 20 and 21 are in an actuated, depressed position in which the related electrical circuits connected to microswitches 18, 19 are isolated from the current source. When the control lever 2 is displaced from its rest position to a position such as that shown in phantom lines in FIG. 2, being laterally moved within the opening 10 of plate 9, the conical portion of member 6 slides along one edge of opening 10, the opposite portion of the frustum being lifted entirely from the opening, and plate 8 is also tilted through a predetermined angle, the outer periphery thereof coming in contact with the upper surface of plate 9. Thus, the lower surface of plate 8 is separated from operaters 20 and 21, permitting those operaters to return to their rest positions and permitting the normally closed switches to which they are connected to return to their closed positions, connecting the associated electrical circuits to the current source. By this technique, additional security is obtained with the remote control operation. The apparatus is configured such that at least one of the two operaters 20, 21 must be released by control plate 8 in order for the electrical circuit connected to the remote control to remain connected.

When the control lever 2 is swiveled away from its rest position, restoring spring 14 continually urges plate 8 and frustum 6 toward the coupling end of the lever, pressing the frustum against the side edges of opening 10 and attempting to return the lever to its rest position in which potentiometers 15 return to zero and in which the operaters 20, 21 of microswitches 18, 19 are operated, disconnecting the electric circuit controlled by these switches from the current source. Double security of the remote control is thus attained.

As shown in FIG. 2, with the displacement of control lever 2 from its rest position, restoring spring 14 is biased in proportion to the amount of displacement of the control lever. The bias of the restoring spring is affected by frustum 6 which works against the edge of opening 10 and, with the displacement of control lever 2, is forced against the effect of the restoring spring working against washer 12.

The maximum swivel angle of control lever 2 is determined to be the same in the diagonals of opening 10 and in the detent notches 11. As will be recognized, the described control mechanism can also be used as a remote control.

While one advantageous embodiment has been chosen to illustrate the invention it will be understood by those skilled in the art that various changes and modifications can be made therein without departing from the scope of the invention as defined in the appended claims.

What is claimed is:

1. A control mechanism comprising a housing;

a guide plate mounted on said housing, said plate having an opening therein;

at least one electrical component having an operator element extending through said guide plate adjacent said opening;

a control lever extending through said opening, said control lever having a handle end outside of said housing and a coupling end mounted within said housing to permit movement of said lever in various directions from a control, rest position;

a frustoconical pivot member slidably mounted coaxially on said control lever with the smaller end thereof extending into said housing through said opening, the larger end thereof being dimensioned to engage said opening;

a restoring spring urging said pivot member toward said coupling end of said lever;

a control plate attached to the larger end of said pivot member for tilting movement with said pivot member and said lever between a rest position with the rest position of said lever in which said control plate engages said operator element and tilting positions in which said element is not engaged.

2. A mechanism according to claim 1 which includes two components and two operator elements spaced apart from each other.

3. A mechanism according to claim 2 wherein both of said operator elements lie in planes containing said control lever outside of a diagonal of said opening.

4. A mechanism according to claim 1 wherein said opening is generally rectangular and includes means defining a detent notch in each side thereof for receiving said control lever.

5. A mechanism according to claim 1 and including articulation means for coupling said layer in said housing comprising two interlocked U-shaped rods opening in opposite directions and lying in perpendicular planes, one of said rods being attached to said lever and the other to said housing.

* * * * *